US006457613B1

(12) United States Patent
Patterson

(10) Patent No.: US 6,457,613 B1
(45) Date of Patent: Oct. 1, 2002

(54) CONTAINER EQUIPPED WITH PROTECTIVE SEAL

(76) Inventor: Eugene Ennalls Patterson, 2007 Ryan's Run Rd., Lansdale, PA (US) 19446

( * ) Notice: Subject to any disclaimer, the term of this patent is extended or adjusted under 35 U.S.C. 154(b) by 0 days.

(21) Appl. No.: 09/755,912

(22) Filed: Jan. 8, 2001

(51) Int. Cl.[7] ..... B65D 5/72

(52) U.S. Cl. ..... 222/494; 222/481.5; 222/484; 215/232; 215/310; 220/89.1; 220/367.1; 137/849; 137/493.8

(58) Field of Search ..... 222/481.5, 482, 222/490, 494, 484, 212, 479, 541.5, 541.6; 137/849, 493.1, 493.8, 493, 68.19, 68.21, 68.27; 141/114, 366; 220/229, 367.1, 89.1, 89.2; 215/232, 307, 253, 310, 254, 256; 277/628, 917, 634

(56) References Cited

U.S. PATENT DOCUMENTS 953,300 A * 3/1910 Schulz
1,989,145 A * 1/1935 Newby
2,679,954 A * 6/1954 Barnes
2,793,373 A * 5/1957 Ewing
2,937,658 A * 5/1960 Stewart
2,968,314 A * 1/1961 Whitworth
3,072,288 A * 1/1963 Lemmer
3,334,779 A * 8/1967 Smith
3,490,488 A * 1/1970 Grist
3,525,357 A * 8/1970 Koreski
3,669,323 A * 6/1972 Harker et al.
3,698,598 A * 10/1972 Wood et al.
3,722,734 A * 3/1973 Raidl, Jr.
3,845,879 A * 11/1974 Dernbach et al.
3,964,509 A * 6/1976 Daubenberger et al.
4,308,885 A * 1/1982 Geisseler
4,331,254 A * 5/1982 Haggerty
4,727,999 A * 3/1988 Gach
4,728,006 A * 3/1988 Drobish et al.
4,762,308 A * 8/1988 Geno
4,938,390 A 7/1990 Markva
4,949,857 A 8/1990 Russell
4,991,745 A * 2/1991 Brown
5,033,655 A * 7/1991 Brown
5,044,531 A * 9/1991 Rhodes, Jr.
5,316,058 A 5/1994 Spektor et al.
5,472,021 A * 12/1995 Tsao et al.
5,634,504 A * 6/1997 Chandler
5,636,772 A 6/1997 Poulsen
5,687,865 A * 11/1997 Adams et al.
5,687,867 A * 11/1997 Lamoureux
5,845,821 A * 12/1998 Chou
6,032,812 A * 3/2000 Lamoureux
6,286,702 B1 * 9/2001 Bauerman

FOREIGN PATENT DOCUMENTS

EP 463658 * 5/1991
FR 2701694 * 2/1993

* cited by examiner

*Primary Examiner*—Allan N. Shoap
*Assistant Examiner*—Robin Hylton
(74) *Attorney, Agent, or Firm*—Joseph W. Molasky & Associates

(57) ABSTRACT

A container equipped with a rupturable retaining seal which, when broken, forms a spout from which the contents of the container may be poured. The rupturable seal is secured along its peripheral edge to the top opening of the container and contains a pinpoint hole at its epicenter. Arranged serially about the pinpoint hole in spoke-like fashion, are an impressed pattern of separable incisions which, when pressure is applied, separate and form an opening from which the contents of the container can be poured.

8 Claims, 3 Drawing Sheets

CONTAINER EQUIPPED WITH PROTECTIVE SEAL

This invention relates to a container for dispensing a liquid into an opening which is poorly accessible.

More specifically, this invention relates to a container having a frangible seal which, when broken, forms a spout and allows the contents to be controllably poured into the inlet opening of an engine.

BACKGROUND OF THE INVENTION

When motor oil is poured directly into an oil inlet port, either directly or via a funnel, it flows slowly at first, then in spurts, and spillage invariably occurs. A funnel only exacerbates the problem because once inserted into the inlet opening, it must be raised periodically so that air can enter, otherwise, an air lock will form as the funnel blocks the flow of air into the engine and, as a result, the oil overflows.

Carl D. Russell, in U.S. Pat. No. 4,949,857, sought to overcome this problem by providing a motor oil bottle having a seal that can be broken by applying manual pressure to the sides of the container. Once the spigot end of the container is inserted into the oil inlet and manual pressure is applied, the broken seal forms a spout as the result of a predetermined breaking pattern. This breaking pattern is deployed in at least two directions so that, when fractured, it creates a two-way valve which admits air to the container and, at the same time, allows the oil to exit.

Unfortunately, the breaking seal and pattern created by Russell, does not create an even flow of oil into the inlet tank and, instead, the oil flows in spurts over the engine valve cover.

Another squeezable container having a frangible seal is described by Edward J. Klassen in U.S. Pat. No. 4,133,457. In this system, the valve (i.e., septum) remains open and the contents of the container can be discharged so long as it is squeezed. Once the squeezing stops, the valve, or septum reseals itself and the unused contents can be stored.

The difficulty with U.S. Pat. No. 4,133,457 is that it fails to provide a sealing closure member which avoids the spilling of motor oil onto the valve cover of the engine. The septum or seal in this patent does not provide a spout from which a steady stream of motor oil is emitted; instead, the oil is discharged in spurts and it invariably spills onto the engine.

The dispensing container described by Neil Markva in U.S. Pat. No. 4,938,390, improves on U.S. Pat. No. 4,133,457 by providing a rupturable membrane or seal having both a "fixed section" and a "tacked section." When the container is squeezed, the fixed section remains in place, that is, fixed to the peripheral edges of the container opening, whereas, the tacked section has a "bursting open portion" or "tear line" which is ruptured when the container is squeezed and this forms a discharge opening.

Although U.S. Pat. No. 4,938,390 is an improvement on known containers, it suffers the same drawbacks. For one, the discharge opening formed upon squeezing the container sidewalls, does not create an even flow of oil into the oil inlet; instead, the oil is emitted in spurts so that it invariably spills onto the engine and environs. Moreover, the opening in the membrane is such that it does not allow sufficient air to reenter the bottle for further dispensing when the container is squeezed again.

Accordingly, there is a need for an oil dispensing container which will allow a user to pour motor oil into the inlet opening of an auto engine with an even flow and in such manner as to avoid spilling onto the engine per se.

SUMMARY OF THE INVENTION

The object of this invention is to provide a storage container for controllably dispensing a liquid into a small-sized opening.

A further object provides for a liquid storage container having a seal closure means which can be opened by squeezing the sides of the container while inverted and in registry with the oil inlet opening of an engine.

Still, another object is to provide a liquid storage container in which the closure means is a frangible membrane or film having a pinpoint hole at its center and an impressed pattern of serially disposed incisions which, when broken, form an opening from which the contents of the container can be poured.

The container and seal of this invention have particular application in dispensing motor oil into an engine; however, it will be appreciated by those skilled in this field that this invention may be used to dispense any liquid or other flowable material neatly into a small-sized opening.

Another object, and a preferred embodiment of this invention, provides for a container having a cylindrical neck and a top opening to which is secured a rupturable retaining seal and threaded cap. The seal is secured along its peripheral edge to the top opening of said neck and its center contains a pinpoint hole or opening through which the contents of the container are impelled to flow in a thin stream once the threaded cap is removed and the container is inverted.

A unique feature resides in the configuration and disposition of the incisions which are serially arranged on the container seal. These incisions are of two lengths, one abbreviated and the other longitudinally extended. Both are arranged in spoke-like fashion around the center hole or pinpoint hole at the center of this seal so that when fully open, they form, in combination, a drain from which the contents of the container can be poured.

The incisions play a unique role in forming the drain opening of this invention and they distinguish the present container and seal from those which are known. When the body portion of the container is inverted and manually squeezed, the longitudinally extending incisions rupture or separate entirely in the direction of the pinpoint hole to form a drain opening. This ensures a complete opening when manual pressure is applied. On the other hand, the abbreviated incisions, once opened, do not extend to the center hole; instead, they burst open along the incision line and contribute to the formation of the drain opening by allowing the seal to bend backwards. This interaction between the abbreviated incisions and longitudinal incisions results in the formation of a drain opening which is unique because it permits the contents of the container to be poured evenly and smoothly without spurts and surges.

Also, unlike Markva (U.S. Pat. No. 4,938,390), the seal of this invention is characterized by incisions which are completely open, that is, they do not rupture or 'break open' when the container is manually squeezed but, instead, they separate. In Markva, the seal or membrane is unitary and must be broken open to discharge the container's contents.

In this invention, the incisions are left open by design and they separate only after the cap is removed, the container is inverted and squeezing is applied. To be sure, a small amount of oil escapes once the cap is removed and the container is inverted, but this is a manageable amount and it does not impair the user's ability to control fluid flow. Moreover, the incisions cannot separate so long as the cap remains in place because the film and its incisions lie tightly against the inside of the cap and they thus remain in place until the pouring step is commenced. A gauge of foil or film is important to the threshold of pressure required to control fluid flow.

These and other features of the invention will become apparent from the accompanying drawings and preferred embodiment. These show basically a container and retaining seal in which the container has a cylindrical neck equipped with a threaded vertical wall for engaging a threaded cap. The neck terminates in a top opening through which the contents of the container may be poured.

The seal of this container is secured to the top opening of the neck by adhesive or heat seal means or the like and it is comprised of separate sections which open under pressure so as to expose the contents of the container and provide a spout or drain from which the contents may be poured. The seal is characterized by the following features:

(1) it is impervious to liquids;

(2) it is secured peripherally to the top edge opening of said neck;

(3) it contains at its center a pin-point hole or center hole; and (4) it contains a pattern of separable incisions which lie serially about the pinpoint hole, in spoke-like fashion so that, when separated, they form a spout or drain opening from which the contents of the container can be poured.

The incisions extend inwardly of the peripheral edge in the direction of the pinpoint hole and they are of two lengths, one abbreviated and the other being of greater degree and longitudinally extended. They are arranged in a sequential pattern, one after the other.

The following drawings form a part of this invention and show an embodiment which is illustrative but not limitative of the invention which is sought to be covered.

DETAILED DESCRIPTION OF THE PREFERRED EMBODIMENTS

Figure 1:
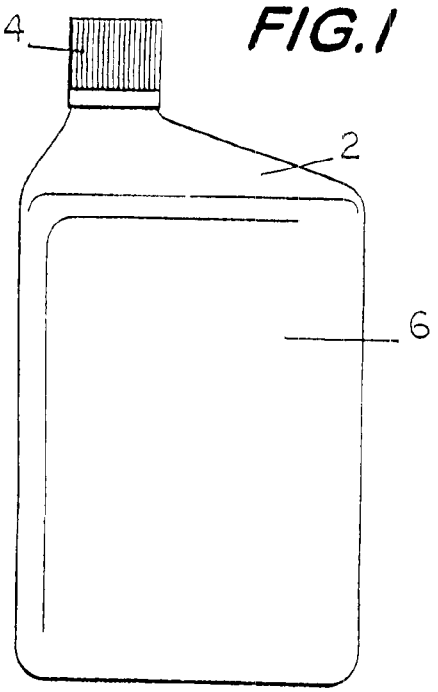
FIG. 1 is a side view of the container of this invention shown in an upright position as it is to be stored.
Figure 2:
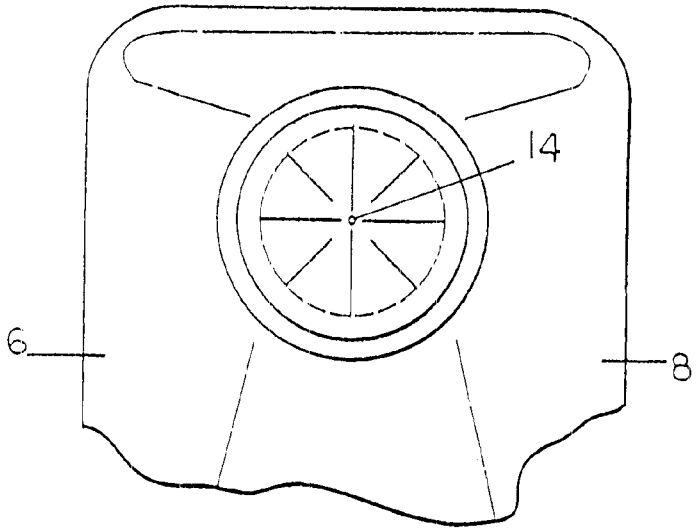
FIG. 2 is a fragmentary top plan view of the container of this invention with its storage cap removed and seal intact.
Figure 3:
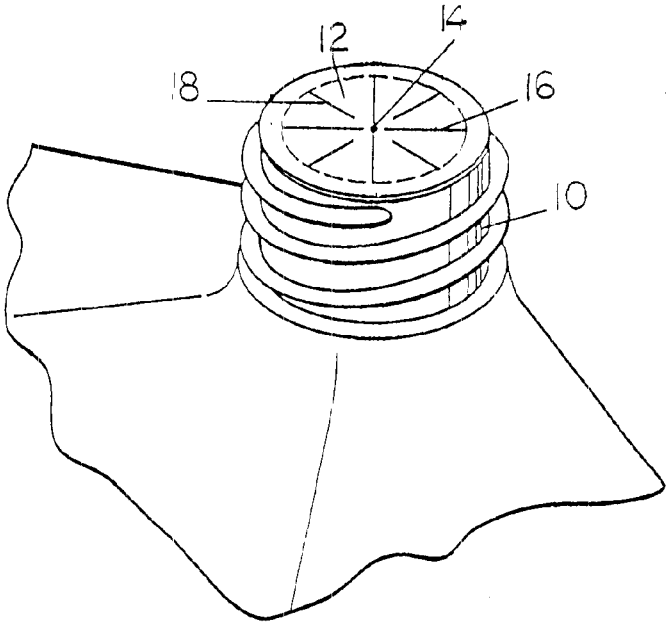
FIG. 3 is an enlarged fragmentary perspective view of the container shown in FIG. 2.

The container 2 of this invention is shown generally in FIG. 1 where it is depicted in a storage mode with storage cap 4 in place. This receptacle is made of plastic and its body portion is thin-walled and flexible so that its sides 6 and 8 can be manually squeezed to exert internal pressure on the container contents.

The neck 10 of the container 2 is threaded to receive a like-threaded cap 4 and its discharge opening is sealed by a fluid impervious film or membrane 12. The film 12 is secured peripherally to the topmost wall of the discharge opening to create a control against premature flow. An adhesive holds the film fixedly in place against the container and it is of such strength that when the container is inverted, the seal will remain intact even under the weight of container's contents until any pressure is squeezably applied.

Impressed onto the film, beginning at the peripheral edge of the container, there are arranged in serial fashion, a series of separable incisions which extend in the direction of the film's epicenter. The epicenter is that point which is close proximity to the true center of the seal but not the true or absolute center per se. Located at the epicenter is a pinpoint hole 14 or opening through which the contents of the container may flow once the cap 4 is removed and the container is inverted. The incisions are open by design but they cannot separate so long as the cap is threadedly engaged because they lie tightly against the inside of the cap and thus remain in place until the cap is removed and the pouring step is begun. Once the cap is removed and pressure is applied to the sides of the container, the incisions separate and combine to form a spout or drain opening from which the contents of the container can be poured.

These separable incisions extend from that portion of the film which is secured peripherally to the wall edge of the container 2 and they terminate some delimited distance from the pinpoint hole. They are of two lengths, one set being shorter than the other, and although both contribute to the formation of the drain opening, they serve radically different purposes. The longer incisions 16, that is, those which are longitudinally extended and which terminate in close proximity to the pinpoint hole, separate under pressure and together with the pinpoint hole, they form the opening through which the contents of the container are poured.

Figure 4:
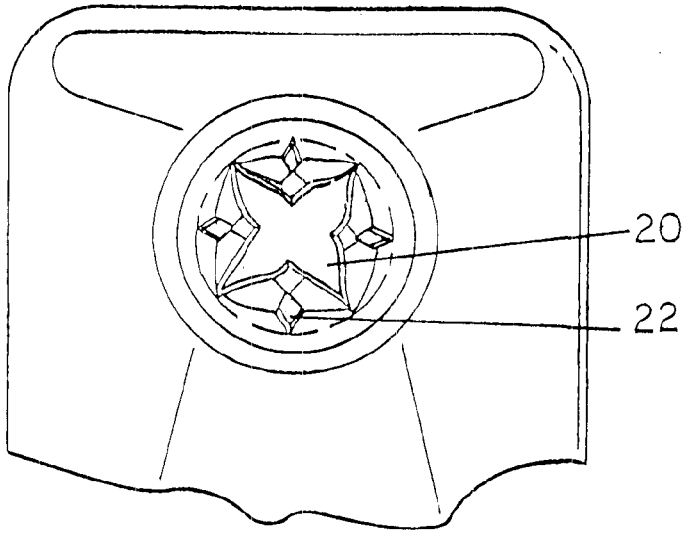
FIG. 4 is a fragmentary perspective view of the container of FIG. 2 shown in an open mode.
Figure 5:
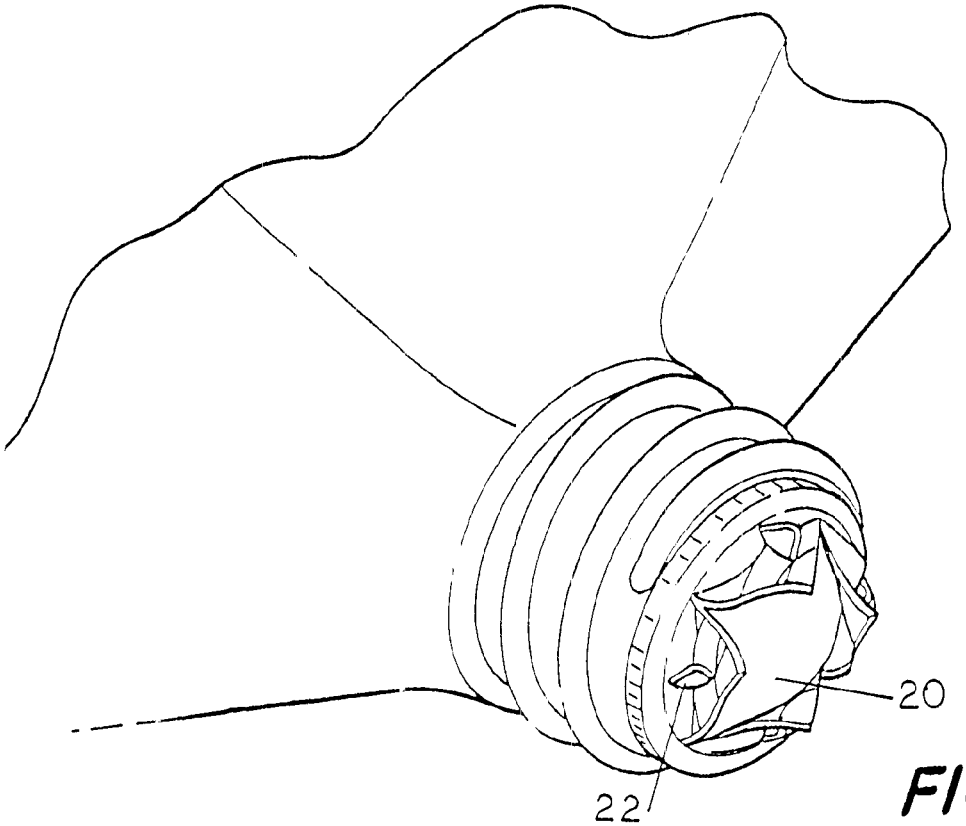
FIG. 5 is an enlarged fragmentary perspective view of the container of FIG. 4 shown from the side.
Figure 6:
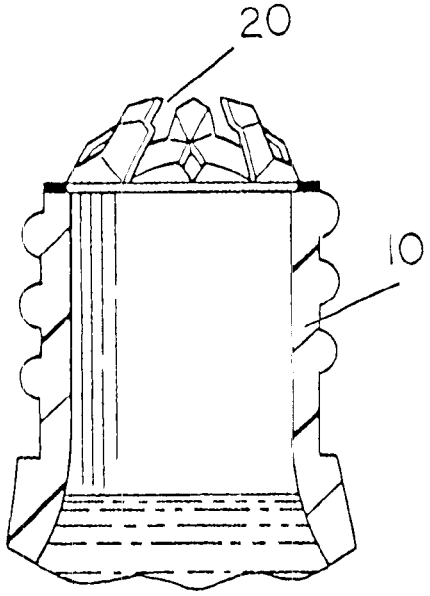
FIG. 6 is a fragmentary view of the neck and seal portion of the container of this invention shown in cross-section.
Figure 7:
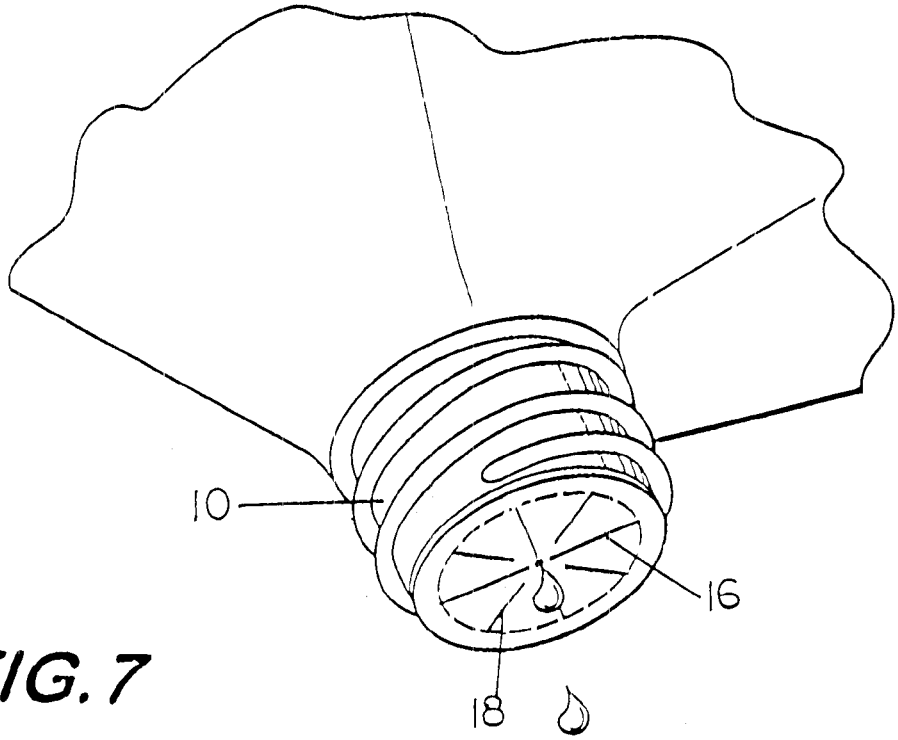
FIG. 7 is a fragmentary perspective view of the container of this invention shown in an inverted mode with its contents being discharged in drop-wise fashion.

The abbreviated incisions 18, on the other hand, do not combine with the pinpoint hole to form a drain opening per se; instead, they contribute to the formation of the drain by separating along their respective incision lines in a manner which induces the seal to bend backwards in a spout-forming arrangement 20. Once the seal has been broken and the spout 20 has been formed, the abbreviated incisions 18 form those diamond-shaped apertures which are shown as 22 in FIGS. 4 and 5. These apertures 22 have the salutary effect of allowing ambient air to enter the container once it is inverted and this allows the oil or other contents to flow smoothly and uninterruptedly. The result of this interaction between the abbreviated incisions and the longitudinally extending incisions is best illustrated by the drain opening structure shown in FIGS. 4 and 5 where it is shown to result in the formation of a spout 20 from which the contents of the container can be poured evenly and smoothly without spurts and surges.

This invention has been described by reference to precise embodiments; however, it will be appreciated by those skilled in this art that the present invention is subject to modification, and to the extent that any such modification would be obvious to one of ordinary skill, it is considered to be within the scope of the appended claims.

What is claimed is:

1. The combination of a container and a retaining seal, said container having a cylindrical neck, which neck has a threaded vertical wall for engaging a threaded cap and terminates in a top opening, said seal being secured to the top opening but separable in part so that the contents of the container may be poured therefrom; wherein said seal:

(1) is a film which is impervious to liquids;

(2) is secured along its peripheral edge to the top opening of said neck;

(3) contains a pinpoint hole at its epicenter; and (4) contains a pattern of separable incisions which are arranged serially about the hole in spoke fashion so that, when separated, they form a drain opening from which the contents of the container can flow, wherein the incisions of said seal extend inwardly and are of two lengths, one abbreviated and the other being longitudinally extended, said incisions being in a sequential pattern, one after the other.

2. The combination of claim 1 wherein the longitudinally extended incisions, when separated, in combination with the pinpoint hole, form a drain opening.

3. The combination of claim 1 wherein the abbreviated incisions, when separated, form a series of scissions which circumscribe the pinpoint hole and facilitate the formation of the drain opening by reducing the tensile strength of each quadrant.

4. The combination seal of claim 1 wherein said film is a foil.

5. The combination seal of claim 1 wherein said film is a plastic.

6. The combination seal of claim 1 wherein said film is secured to the top opening by adhesive means.

7. The combination seal of claim 1 wherein said film is secured to the top opening by heat-seal means.

8. In a container having a cylindrical neck and a top opening secured by a retaining seal; the improvement which comprises, utilizing as said seal, a film:

(1) which is impervious to liquids;

(2) secured along its peripheral edge to the top opening of said neck;

(3) contains a pinpoint hole at its epicenter; and (4) contains an impressed pattern of separable incisions which are arranged serially about the hole in spoke fashion so that, when separated, they form an opening from which the contents of the container can flow, wherein the incisions of said seal extend inwardly and are of two lengths, one abbreviated and the other being longitudinally extended, said incisions being in a sequential pattern, one after the other.

* * * * *